United States Patent [19]

Yates

[11] 4,194,595

[45] Mar. 25, 1980

[54] DEAD LEVER ANCHORING MEANS FOR RAILWAY CAR BRAKE RIGGING

[75] Inventor: Donald B. Yates, Hueytown, Ala.

[73] Assignee: Pullman Incorporated, Chicago, Ill.

[21] Appl. No.: 926,188

[22] Filed: Jul. 20, 1978

[51] Int. Cl.[2] ..... B61H 13/38

[52] U.S. Cl. ..... 188/52; 188/205 R; 248/340

[58] Field of Search ..... 188/33, 46, 47, 52, 188/53, 54, 55, 107, 153 R, 153 A, 205 R, 209, 210; 248/72, 340

[56] References Cited

U.S. PATENT DOCUMENTS

| | | | |
|---|---|---|---|
| 1,274,677 | 8/1918 | Burton | 188/46 |
| 1,654,270 | 12/1927 | Powell | 188/205 R |
| 1,660,014 | 2/1928 | Priebe | 188/205 R |
| 2,271,628 | 2/1942 | Cottrell | 188/210 |
| 2,378,358 | 6/1945 | Flesch | 188/205 R |
| 3,184,000 | 5/1965 | Radey | 188/52 |
| 3,219,156 | 11/1965 | Cale | 188/210 |
| 3,917,025 | 11/1975 | Yates et al. | 188/52 |

*Primary Examiner*—Edward R. Kazenske

*Attorney, Agent, or Firm*—Richard J. Myers

[57] ABSTRACT

An arrangement for a foundation brake rigging on a railway car includes a dead brake lever anchoring arrangement which comprises a bracket supported in openings extending through the walls of the wheel truck bolster. The bracket includes hook-shaped elements which support a generally horizontal connector rod disposed below the bolster. One end of the connector rod is provided with a hinged linkage arrangement, which includes an eye portion which engages and supports a hook-shaped lower end portion of the dead brake lever.

7 Claims, 6 Drawing Figures

DEAD LEVER ANCHORING MEANS FOR RAILWAY CAR BRAKE RIGGING

BACKGROUND OF THE INVENTION

1. Field of the Invention

The invention broadly relates to foundation brake riggings for railway cars. More specifically the invention relates to a dead lever anchoring bracket arrangement which is connected to and supported within the openings in the walls of a truck bolster.

2. Description of the Prior Art

Prior art attempts to anchor one end of the so-called dead lever are shown in the Radey U.S. Pat. No. 3,184,000. This arrangement shows a fixed rod 78 extending between the lower portion of the dead lever and a fixed bracket 79 attached to the car center sill. This has been the generally accepted manner of anchoring the dead lever in brake rigging applications utilizing the so-called under the axle brake rigging of the Radey patent. This disclosure provides an arrangement for anchoring the fixed end of the dead lever to the truck bolster with a simplified bracket arrangement having an adjustable length member.

SUMMARY OF THE INVENTION

Assignee's under-the-axle brake rigging design is disclosed in U.S. Pat. No. 3,184,000, issued to C. R. Radey, May 18, 1965. This patent discloses a foundation brake rigging wherein the brake actuating rods and the brake anchoring rods are disposed below the axles of the wheel truck at one end of the railway car. In this construction, the anchoring rod extends from the lower end of the dead brake lever underneath one axle to a hinged bracket supported on the underframe of the car. The dead brake lever is connected by means of a connecting rod, which extends through openings in the truck bolster, to a live brake lever. The lower end of the live brake lever is pivotally connected to a brake lever actuating rod which extends under the other axle and is pivotally connected to a fulcrum mechanism and brake actuating means, forming the foundation brake rigging.

In the present invention, the brake lever actuating rod which extends from the fulcrum end portion of the air braking system is connected to the lower end of the live brake lever and extends below one of the axles of the wheel truck. The live brake lever is pivotally connected at its upper end to a connecting rod which extends through openings in the bolster and is pivotally connected to the upper end of the dead brake lever. The dead brake lever in the present construction is provided at its lower end with a hook shape which engages an eye of a link, which in turn is pivotally connected to an anchoring bracket which is supported below the lower portion of the truck bolster. The bracket includes hook-shaped portions whic are in engagement with openings in the bolster. The bracket also includes hanger elements extending downwardly from the hook-shaped portions, these elements being connected by means of a rod. The rod is connected to the pivoted link, which supports and retains the dead brake lever of the arrangement. The present arrangement is particularly advantageous in freight cars having a very short overhang where it is sometimes difficult to structurally design an anchor rod capable of transmitting the forces generated by the combined air brake and hand brake to the center-sill structure, especially on cars with a cast draft sill design for a rotary coupler. Therefore, in the present design rather than affix the anchor rod to the center-sill structure, the anchor rod is eliminated and the dead lever anchoring means is anchored directly to the lower portion of the transverse bolster in a manner that can be easily secured and adjusted, and which provides a solid and effective anchoring means for the dead lever.

DESCRIPTION OF THE PREFERRED EMBODIMENT

Figure 1:
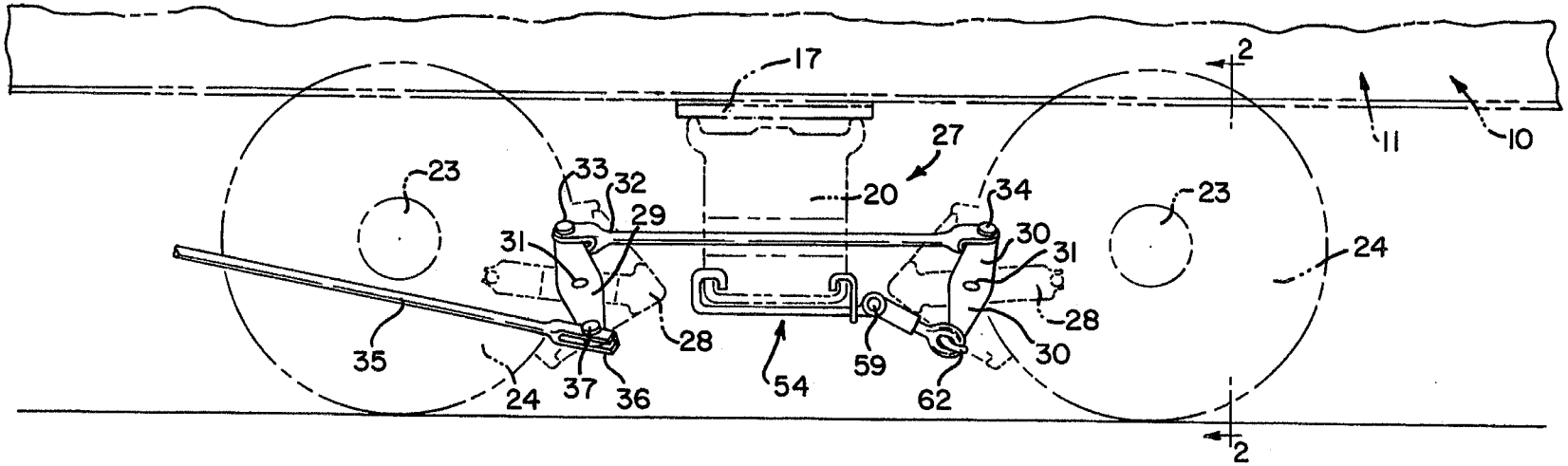
FIG. 1 is a side elevational view of an end portion of a railway car showing a truck bolster and portion of a brake rigging arrangement.
Figure 2:
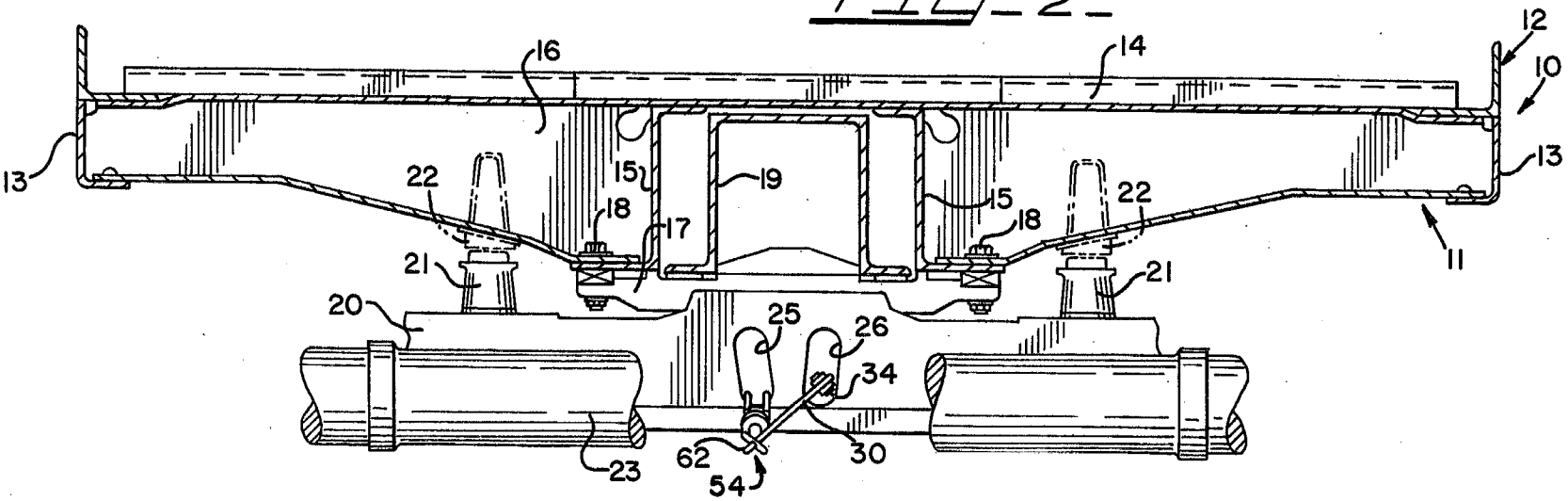
FIG. 2 is a cross-sectional view taken substantially along the line 2—2 of FIG. 1.

Referring particularly to FIGS. 1 and 2, a railway car 10 includes an underframe 11 supporting a car body 12. The car body 12 includes transversely spaced longitudinally extending side sills 13 which suitably support a car floor 14. The underframe 11 comprises center-sill elements 15 extending the length of the car and includes at opposite ends thereof a transverse body bolster 16 of conventional design. A center plate 17 is suitably connected to the transverse body bolster 16 by means of bolts and nuts 18. As best shown in FIG. 2, a cushioned center-sill 19 is slidably disposed within center-sill elements 15, the same being conventional in the art and including suitable hydraulic cushioning means for protecting the lading carried within the car.

A truck bolster 20 is provided for each transverse body bolster 16 and includes truck side bearings 21 which are adapted to engage bolster side bearings 22 in conventional operating relation. A conventional car truck supports each of bolsters 20, the truck frame and associated structure not being shown in detail. Each truck includes axles 23 connected to railway car wheels 24, the axles 23 are positioned on opposite sides of the truck bolster as best shown in FIG. 1. Each truck bolster includes bolster openings 25 and 26 which, in both the design disclosed and the aforementioned Radey patent, provide for the passage of the brake lever connecting rods. These openings, as shown in the Radey patent, are provided on both sides of the longitudinal center line of the car so as to be universal, but the brake lever connecting rod uses only one set of these openings. In the present invention, however, one set of openings permits the passage of the brake lever connecting rods to the brake levers and the other provides a suitable support for the anchoring bracket as will be described.

The foundation brake arrangement is generally designated at 27. Only a portion of the complete brake rigging has been shown in FIG. 1, but the aforementioned Radey patent, which is incorporated herein by reference, discloses the other relevant parts of a complete foundation brake rigging. In FIG. 1, brake beams 28, which include the usual brake shoes, are provided with a live brake lever 29 and a dead brake lever 30. The brake levers 29 and 30 are pivotally connected to the brake beams 28 as indicated at 31. The upper ends of the brake levers 29 and 30 are pivotally connected to a connecting rod 32 by means of pivots 33 and 34, with the rod 32 passing through the bolster opening 26. A fulcrum or brake actuating rod 35 is provided at one end with a clevis 36 connected by means of pivot pin 37 to the lower end of the live brake lever 29.

Figure 3:
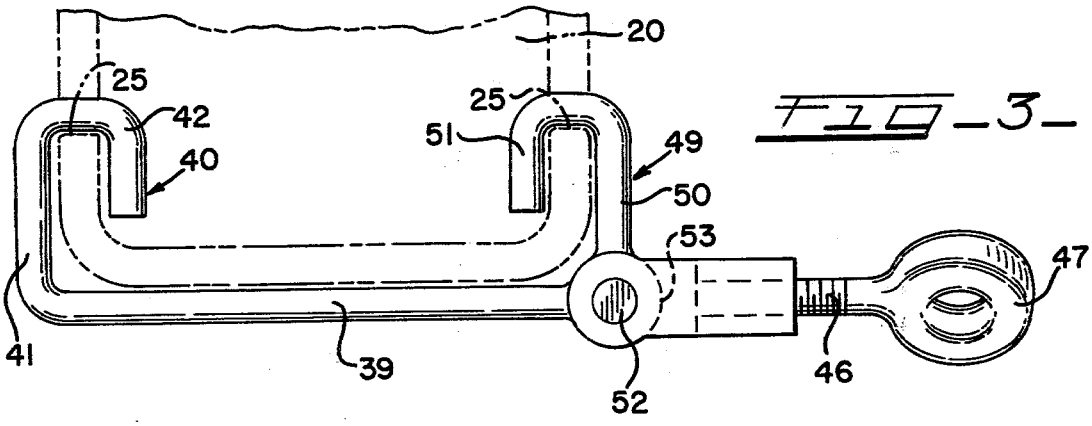
FIG. 3 is a side elevational view of an anchoring bracket connected to the lower portion of a truck bolster.
Figure 4:
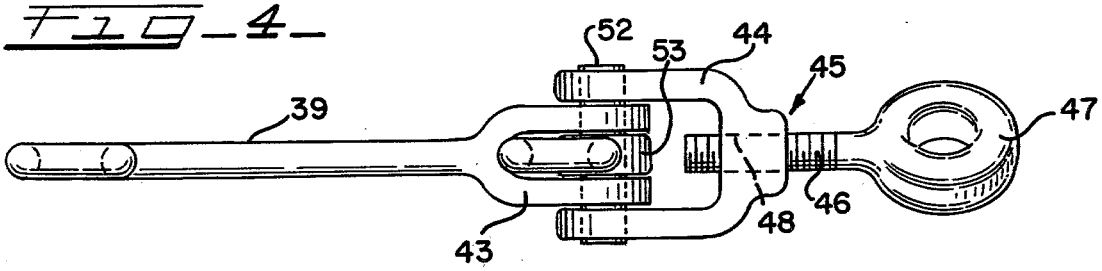
FIG. 4 is a plan view of the anchoring bracket shown in FIG. 3.

As best shown in FIGS. 3 and 4, an anchoring arrangement for the dead brake lever 30 includes a horizontal rod 39 having at one end an integral hanger 40 comprising a vertical rod portion 41 and hook 42, with the hook 42 disposed in engagement with one of the openings 25 of the truck bolster 20. The other end of the rod 39 is provided with a clevis 43 which in turn is in mating relation with a clevis 44 connected to an extensible link arrangement generally designated at 45. The extensible link 45 includes a threaded portion 46 having at one end an eye 47 which, as shown in FIGS. 1 and 2, is adapted to be engaged by a hook 62 of the dead brake lever 30. The extensible link threaded portion 46 extends into a threaded opening 48 provided in the clevis 44. Another hanger 49 comprises a vertical rod portion 50 having an integral hook portion 51 also supported in one of the openings 25 provided in the wall of the bolster 20. The clevises 43 and 44, and eye portion 53 of the hanger 49 are provided with registering or aligned openings within which a pivot pin or hinge member 52 is disposed to secure the parts in assembly.

Figure 5:
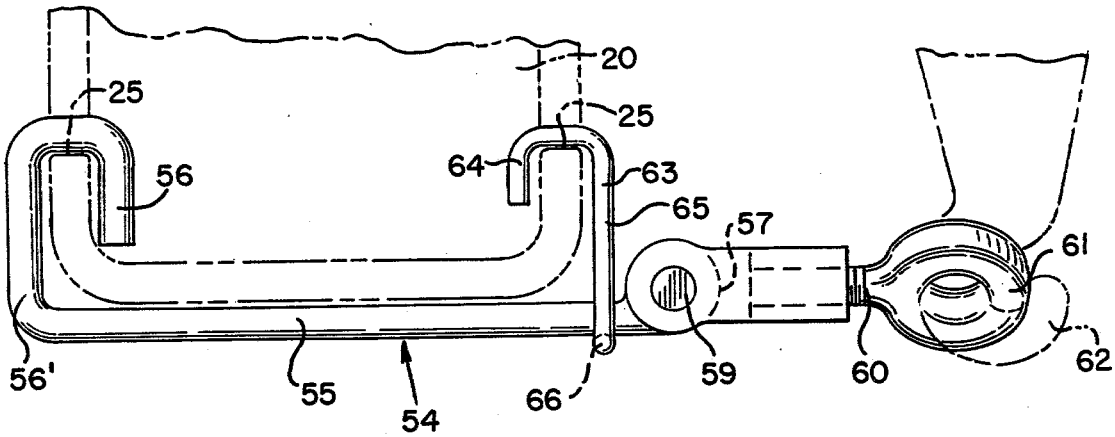
FIG. 5 is a view similar to FIG. 3 showing a modified bracket for anchoring a dead lever to a truck bolster.
Figure 6:
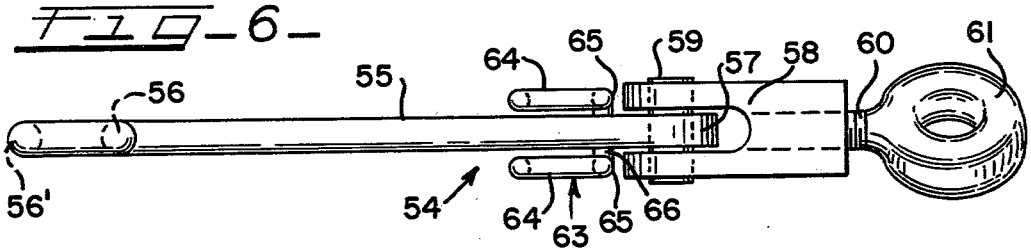
FIG. 6 is a plan view of the anchoring bracket disclosed in FIG. 5.

Thus it can be seen that an improved anchoring arrangement has been disclosed for anchoring the dead brake lever of a foundation brake rigging. FIGS. 5 and 6 disclose a modified bracket arrangement for anchoring the dead brake lever. In this arrangement the anchoring bracket 54 includes a rod 55 having an integral hanger 56' including a hook 56 connected thereto, the same being supported in the opening 25 provided in one of the walls of the bolster 20, as shown in FIG. 5. The rod 55 is provided at one end with an eye portion 57 provided with a suitable opening. A clevis 58 is provided with a pin 59 which extends through the eye portion 57 in hinged relation. The clevis 58 forms part of an extensible link arrangement 60 similar to and threaded as the extensible link arrangement 45 shown in FIGS. 3 and 4. The link 60 is also provided with an eye 61 which is adapted to engage the hook 62 of the dead brake lever 30 as shown in FIG. 1.

A second hanger 63, as shown in FIGS. 5 and 6, includes a pair of vertical legs 65 having hook portions 64 at their upper ends which also engage one of the openings 25 through the wall of the bolster 20. The vertical legs 65 are provided at their lower ends with a transversely extending saddle or transverse leg 66 which, in the position shown in FIGS. 5 and 6, supports the rod 55 in the position indicated.

OPERATION

The operation of the foundation brake rigging is specifically set forth in the aforementioned Radey patent. The essential difference is that in the present invention the dead brake lever is anchored directly to and particularly below the truck bolster by means of the novel bracketing arrangements disclosed, the bracketing arrangements including hanger members which utilize the openings provided in the bolster for securing the anchoring linkage in position. FIGS. 1 and 2 disclose the hanger arrangement of FIGS. 5 and 6, but the hanger arrangement of FIGS. 3 and 4 may also be used as desired. Each of the arrangements shown is equally effective and permits the linkage arrangement supporting the dead lever 30 to accommodate changes in car weight. Since the brake levers are connected to unsprung members and the truck bolster is a sprung member the vertical relationship between the anchoring bracket and the lower end of the dead brake lever 30 changes as the weight within the car changes. Both of the present arrangements accommodate these changes in weight by providing the pivotal connection which positively secures the arrangement to the truck bolster. Another feature of this invention is that the truck assembly can be removed quite easily from beneath the car body without having to disconnect the anchoring rod of the type employed in the aforementioned patented structure.

What is claimed is:

1. In a railway car having a wheeled truck including a truck bolster, a pair of axles journalled for rotation on longitudinally opposite sides of said truck bolster, and a pair of wheels for each axle for supporting the same, a brake rigging arrangement including brake beams positioned on longitudinally opposite sides of said bolster including brake shoe means adapted to engage each of said wheels in braking engagement, first and second brake levers connected to said brake beams, and said brake levers having first, upper ends and second, lower ends, a connecting rod pivotally connected at its opposite ends to said first end of said first and second brake levers, respectively, and brake actuating means pivotally connected to the second end of said first brake lever, the improvement of an anchoring arrangement for said second brake lever comprising:

bracket means connected to said bolster and positioned generally beneath said connecting rod, and linkage means pivotally connected to said bracket means and to the second end of said second lever, said bolster having opening means extending longitudinally of said car therethrough, said connecting rod extending through said openings means, said bracket means including longitudinally spaced first and second hanger members secured within said opening means, and a connecting member extending beneath said bolster and being connected to said hanger members, said linkage means including a link pivotally connected to said connecting member for relative hinging movement about an axis generally transverse to said car, said connecting member comprising a rod with a first end and a second end and said first hanger member supporting one end thereof, said rod having a first clevis at its other end, said link including a second clevis, said second hanger member having a connecting and support portion at one end thereof for interconnecting the second hanger member with the rod, and said connecting and support portion having a pivot means hingedly connecting said first and second clevises to provide said relative hinging movement.

2. The invention in accordance with claim 1, said brake actuating means extending generally longitudinally beneath an axle of said truck.

3. The invention in accordance with claim 1, including means pivotally connecting central portions of said brake levers to said brake beams.

4. The invention in accordance with claim 1, said link being extensible and having an eye portion at one end thereof, and said second brake lever second end including a hook member adapted to engage and be retained by said eye portion.

5. The invention in accordance with claim 1, said linkage means including an eye portion, and said second lever second end including a hook engaged and retained by said eye portion.

6. The invention in accordance with claim 1, said first and second hanger members including hook means supported within said opening means of said bolster.

7. In a railway car having a wheeled truck including a truck bolster, a pair of axles journalled for rotation on longitudinally opposite side of said truck bolster, and a pair of wheels for each axle for supporting the same, a brake rigging arrangement including brake beams positioned on longitudinally opposite sides of said bolster including brake shoe means adapted to engage each of said wheels in braking engagement, first and second brake levers connected to said brake beams, and said brake levers having first, upper ends and second, lower ends, a connecting rod pivotally connected at its opposite ends to said first ends of said first and second brake levers, respectively, and brake actuating means pivotally connected to the second end of said first brake lever, the improvement of an anchoring arrangement for said second brake lever comprising:

bracket means connected to said bolster and positioned generally beneath said connecting rod, and linkage means pivotally connected to said bracket means and to the second end of said second lever, said bolster having opening means extending generally longitudinally of said car therethrough, said connecting rod extending through said opening means, and said bracket means including hanger means supported within said opening means, said hanger means including a first hanger member supported within said opening means, a bracket rod supported at its first end by said first hanger member and extending below said bolster, said bracket rod having a connecting portion at its other end, said linkage means including link means pivotally connected at one end to said connecting portion of said bracket rod, and a second hanger member supporting the connecting portion of said bracket rod, said second hanger member being supported within said opening means of the bolster, said second hanger member including hook means engaging said opening means and having a saddle portion depending from said hook means for supporting said connecting portion of said bracket rod, said second hanger member being positionable longitudinally along said bracket rod, said hook means of said second hanger member including a pair of hook elements each having a depending leg portion, said leg portions being in generally parallel-spaced relation, said saddle portion extending between lower end portions of said leg portions and being disposed below said bracket rod.

* * * * *